US006880909B2

(12) United States Patent
King et al.

(10) Patent No.: US 6,880,909 B2
(45) Date of Patent: Apr. 19, 2005

(54) METHOD AND APPARATUS FOR ADJUSTING DROP VELOCITY

(75) Inventors: David G. King, Shelbyville, KY (US); Patrick L. Kroger, Versailles, KY (US)

(73) Assignee: Lexmark International Inc., Lexington, KY (US)

( * ) Notice: Subject to any disclaimer, the term of this patent is extended or adjusted under 35 U.S.C. 154(b) by 34 days.

(21) Appl. No.: 10/420,601

(22) Filed: Apr. 22, 2003

(65) Prior Publication Data

US 2004/0212650 A1 Oct. 28, 2004

(51) Int. Cl.[7] ..... B41J 29/393
(52) U.S. Cl. ..... 347/19
(58) Field of Search ..... 347/14, 19

(56) References Cited

U.S. PATENT DOCUMENTS 6,116,717 A * 9/2000 Anderson et al. ..... 347/19
6,669,321 B1 * 12/2003 Yoshida ..... 347/19
6,669,324 B1 * 12/2003 King et al. ..... 347/19

* cited by examiner

*Primary Examiner*—Lamson Nguyen
*Assistant Examiner*—Blaise Mouttet
(74) *Attorney, Agent, or Firm*—Taylor & Aust PC

(57) ABSTRACT

In an ink jet printer, a method of selecting an optimized energy level associated with a target ink drop velocity including the acts of: moving a printhead across a print medium at a plurality of scan velocities including a first velocity and a second velocity, printing at least one set of patterns on the print medium by supplying at least one predetermined energy level to at least one actuator of the printhead, the at least one set of patterns including a first pattern printed at the first velocity and a second pattern printed at the second velocity, associating the first pattern with the second pattern and selecting the optimized energy level associated with the target ink drop velocity.

24 Claims, 5 Drawing Sheets

METHOD AND APPARATUS FOR ADJUSTING DROP VELOCITY

CROSS REFERENCE TO RELATED APPLICATIONS

This application includes subject matter related to the co-pending application entitled METHOD FOR DETERMINING INK DROP VELOCITY OF CARRIER-MOUNTED PRINTHEAD, application Ser. No. 10/175,972, filed Jun. 20, 2002, and the application entitled METHOD AND APPARATUS FOR OPTIMIZING A RELATIONSHIP BETWEEN FIRE ENERGY AND DROP VELOCITY IN AN IMAGING DEVICE, application Ser. No. 10/304,148, filed Nov. 25, 2002, each of which are incorporated by reference herein.

BACKGROUND OF THE INVENTION

1. Field of the Invention

The present invention relates to a method and apparatus for adjusting ink drop velocity, and, more particularly, in one embodiment, to a method and apparatus for adjusting ink drop velocity irrespective of sensors.

2. Description of the Related Art

An ink jet printer typically includes a printhead, which is carried by a carrier. The printhead is fluidly coupled to an ink supply. Such a printhead includes a plurality of nozzles having corresponding ink ejection actuators, such as heater elements.

Ink is jetted from the nozzles onto a print medium at selected ink dot locations within an image area. The carrier moves the printhead across the print medium in a scan direction while the ink dots are jetted onto selected pixel locations within a given raster line. Between passes of the printhead, the print medium is advanced a predetermined distance and the printhead is again moved across the print medium.

Ink jet printers may utilize a single printhead, or multiple printheads. For example, some ink jet printing systems utilize a monochrome ink cartridge including a monochrome, e.g., black, printhead, and a color ink cartridge including a color printhead having cyan, magenta and yellow nozzle groups. In another type of ink jet printing system, each printhead is connected to a respective remote ink supply.

The manufacture of printheads involves certain manufacturing tolerances that result in manufacturing variations (e.g., variations in sheet resistance of the material used in the heater elements; mask alignment variations, which lead to variations in the width and length of heater elements; the rise and fall times of transistors that drive the heater elements; the thickness of the layer between the heater element and the ink, which influences heat transfer to the ink; the ink chemistry; and the voltage level of the power source), which in turn result in printheads that require differing amounts of energy to attain a drop velocity deemed suitable (e.g., high enough) for attaining a desired print quality. Thus, typically, from printhead to printhead, the amount of energy required to attain a suitable drop velocity varies.

Because of these manufacturing variations, an energy level for driving such printheads will be selected so that most printheads will attain a certain minimum drop velocity (e.g., 400–600 inches per second). This energy level is a statistical average value meant to encompass the largest range of printhead variations possible. Because the same predetermined amount of energy is used for each printhead, the energy is not optimized for a particular printhead.

One problem with this manner of ink delivery is that variations in printheads lead to inefficiencies in printhead operation. The result is ink drop velocity variations and difficulty in maintaining nominal head temperatures. Another problem is that driving ink jet heater elements at an energy level required to jet ink at an acceptable drop velocity means overdriving some printheads. By overdriving printheads, the overdriven nozzles can fail prematurely due to electromigration of the heater element.

What is needed in the art is a method and apparatus that reduces variations in drop velocities among a type of printhead, and/or provides for fire energy adjustment for the printhead.

SUMMARY OF THE INVENTION

The present invention provides, in one embodiment, an apparatus and a method for adjusting energy used to eject ink.

The invention comprises, in one form thereof, in an ink jet printer, a method of selecting an optimized energy level associated with a target ink drop velocity including the acts of: moving a printhead across a print medium at a plurality of scan velocities including a first velocity and a second velocity, printing at least one set of patterns on the print medium by supplying at least one predetermined energy level to at least one actuator of the printhead, the at least one set of patterns including a first pattern printed at the first velocity and a second pattern printed at the second velocity, and selecting the optimized energy level associated with the target ink drop velocity based on an association of the first pattern with the second pattern.

The invention comprises, in another form thereof, in an ink jet printer, a method of selecting an optimized energy level associated with a target ink drop velocity including the acts of: printing a first pattern on a print medium by supplying an energy level to at least one actuator, the first pattern printed at a first carrier velocity, printing a second pattern on the print medium by supplying the energy level to the at least one actuator, the second pattern printed at a second carrier velocity, obtaining information as to an alignment of the first pattern and the second pattern and assigning the optimized energy level based on the information.

The invention comprises, in still another form thereof, in an ink jet printer, a method of selecting an actuator energy level associated with a target ink drop velocity, comprising the acts of: selecting an energy level to supply to at least one actuator to eject ink from a printhead, moving the printhead at a first velocity, placing ink drops from the printhead on a print medium, moving the printhead at a second velocity, placing additional ink drops on the print medium and assigning an energy level associated with the target ink drop velocity as the actuator energy level.

An advantage of certain embodiments of the present invention is that the energy used in an ink jet printer printhead is optimized thereby increasing the life of the printhead.

Another advantage of certain embodiments of the present invention is that the printhead heats less; thus, throughput levels of the printer can increase since the time required to cool a printhead is reduced or eliminated.

A further advantage of certain embodiments of the present invention is that variations that occur in the manufacture of the printhead can be compensated.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
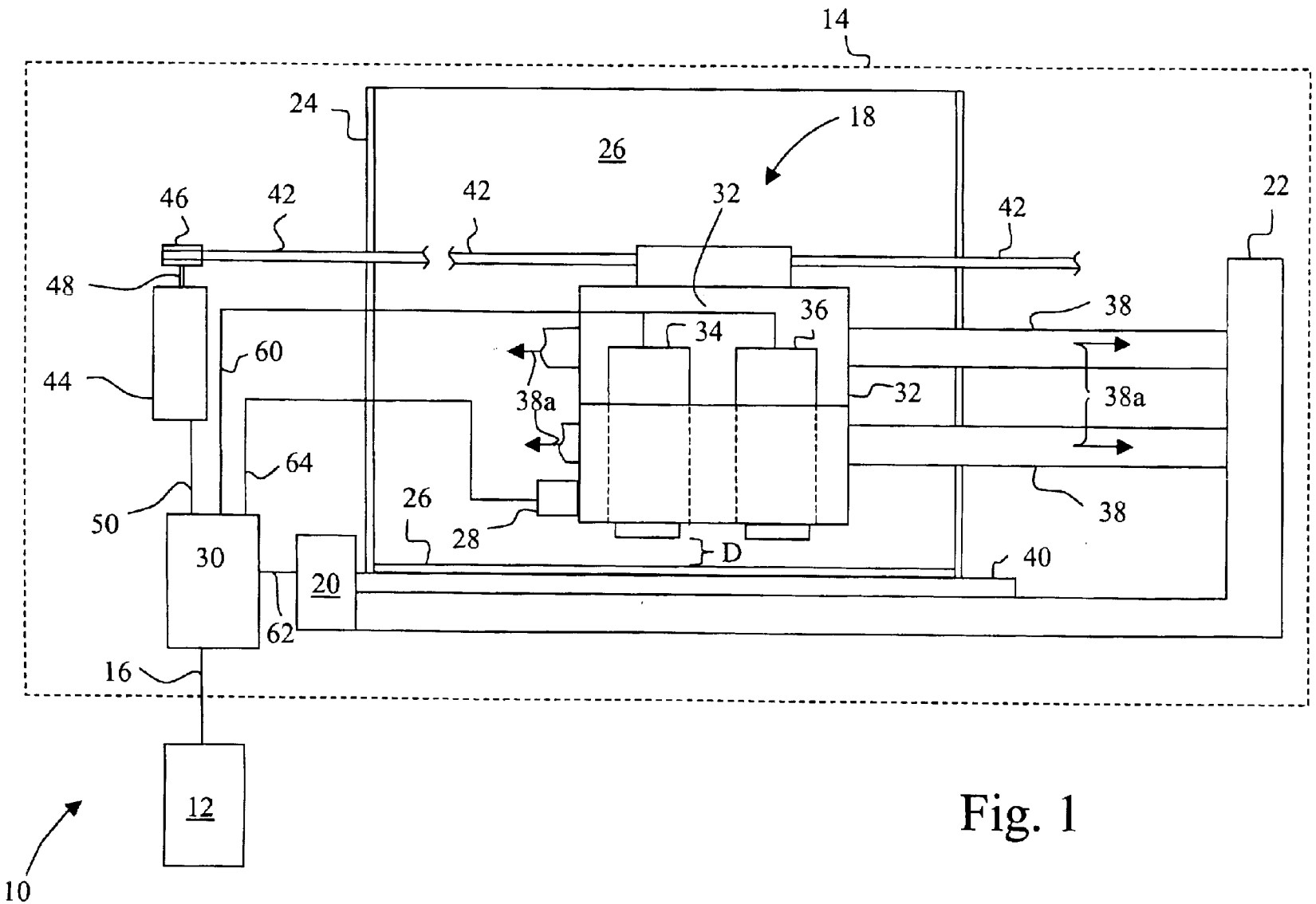
FIG. 1 is a diagrammatic representation of an imaging system incorporating an embodiment of a method of the present invention.

Referring now to the drawings, and more particularly to FIG. 1, there is shown an imaging system 10 embodying the present invention. Imaging system 10 includes a computer 12 and an imaging device in the form of an ink jet printer 14. Computer 12 is communicatively coupled to ink jet printer 14 by way of a communications link 16. Communications link 16 may be, for example, an electrical, an optical or a network connection.

Computer 12 is typical of that known in the art, and includes a display, an input device such as a keyboard, a processor and associated memory. Resident in the memory of computer 12 is printer driver software. The printer driver software places print data and print commands in a format that can be recognized by ink jet printer 14.

Ink jet printer 14 includes a carrier system 18, a feed roll unit 20, a frame 22, a media source 24 holding a sheet of print medium 26, a sensor 28 and a controller 30. In some embodiments, printer 14 might also have a sensor 28, such as one used to align a printhead. Carrier system 18 includes a printhead carrier 32, a black printhead 34, a color printhead 36, guide rods 38, a carrier transport belt 42, a carrier motor 44, a driven pulley 46 and a carrier motor shaft 48. Carrier system 18 and printheads 34 and 36 may be configured for unidirectional printing or bi-directional printing.

Printhead carrier 32 is supported and guided by guide rods 38. Guide rods 38, also known as carrier support 38, are connected to frame 22. Axes 38*a*, associated with guide rods 38, define a bi-directional printing/scanning path of printhead carrier 32. Printhead carrier 32 is slidingly connected to carrier support 38. Printhead carrier 32 is also connected to a carrier transport belt 42 that is driven by carrier motor 44 by way of driven pulley 46.

Controller 30 includes, for example, a processor and associated memory for executing process steps to control the operation of ink jet printer 14. At a directive of controller 30, printhead carrier 32 is transported in a reciprocating manner, along guide rods 38. Carrier motor 44 can be, for example, a direct current drive, servo or a stepper motor.

The reciprocation of printhead carrier 32 transports printheads 34 and 36 across the sheet of print medium 26 along a bi-directional path 38*a*. This reciprocation occurs in a direction that is parallel with bi-directional printing/scanning path 38*a* and is also commonly referred to as the main scan, or horizontal, direction. At the direction of controller 30, the sheet of print medium 26 is fed by feed roll unit 20, including feed roller 40, in an indexed manner under ink jet printheads 34 and 36.

Feed roll unit 20 advances a sheet of print medium 26 through ink jet printer 14 by way of rotation of feed roller 40. Feed roll unit 20 is controllably linked to controller 30. Media source 24 is connected to frame 22 and is configured and arranged to supply individual sheets of print medium 26 to feed roll unit 20, which in turn transports the sheets of print medium 26 during a printing operation.

Controller 30 is linked to carrier motor 44 by way of a communications link 50. Controller 30 controls the speed, direction and acceleration of carrier transport belt 42, which thereby controls the speed, direction and acceleration of printhead carrier 32. Controller 30 is communicatively linked with black printhead 34 and color printhead 36 by way of a communication link 60. Controller 30 selectively actuates one or more actuators that may be in the form of heater elements of printhead 34 and/or 36 by way of communications link 60 to effect the printing of an image on print medium 26. Controller 30 is connected with feed roll unit 20 by way of communications link 62 thereby passing commands for controlling the feeding of print medium 26 through ink jet printer 14.

The fluidic properties of the ink in printheads 34 and 36 play a roll in print quality and throughput. The maximum frequency at which printheads 34 and 36 can eject an ink drop from a nozzle is primarily determined by how quickly an ink chamber can refill. The refill time is related to the force of nucleation. By overdriving some actuator/heater elements and ejecting too much ink, the ink chamber cannot refill quickly enough to print at a given frequency. This means that either the printhead will not eject a drop of ink or that it will eject a drop of the incorrect mass, both of which decrease print quality.

The mechanisms behind the velocity/energy response of the actuators in printhead 34 or 36 relates to the dynamics of bubble formation and expansion. As a bubble forms in printhead 34 or 36, the bubble wall expands outwardly extremely quickly. The bubble itself is filled with a thermally insulating water vapor. This vapor separates and isolates the bubble wall from the heater element nearly instantaneously. Because of this condition, additional energy supplied to the heater element after the onset of nucleation has little or no effect on expansion of the bubble wall. It is the rate of expansion of the bubble wall that provides the pressure pulse that ejects ink from the nozzle of printhead 34 or 36. Energy supplied to the heater element after nucleation is merely dissipated as heat and serves to degrade the performance of printhead 34 or 36.

By controlling the energy used to obtain a desired ink drop velocity, a selection of an optimal energy level can be made for future printing use, thereby optimizing the ink drop velocity while minimizing the amount of heat dissipated in printhead 34 or 36.

Figure 2:
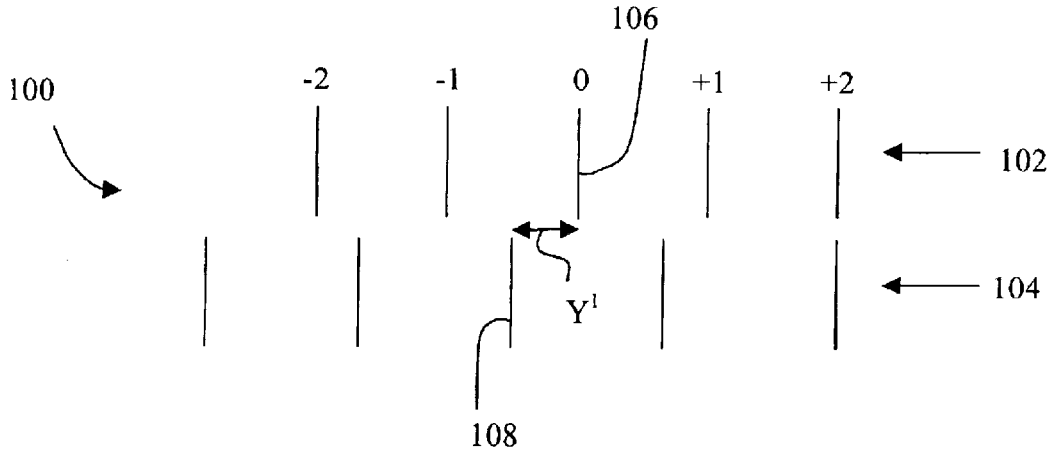
FIG. 2 is a representation of a set of patterns printed by the imaging system of FIG. 1.
Figure 3:
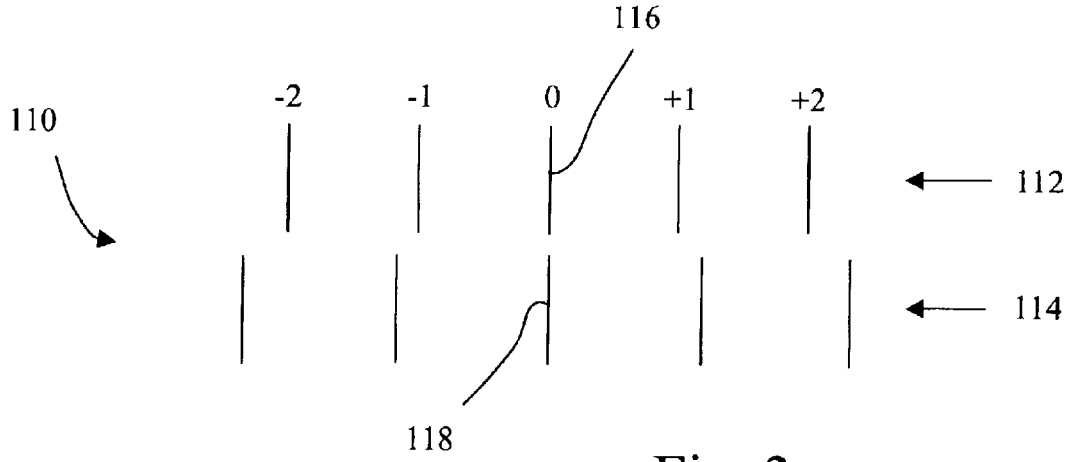
FIG. 3 is a representation of another set of patterns printed by the imaging system of FIG. 1.
Figure 4:
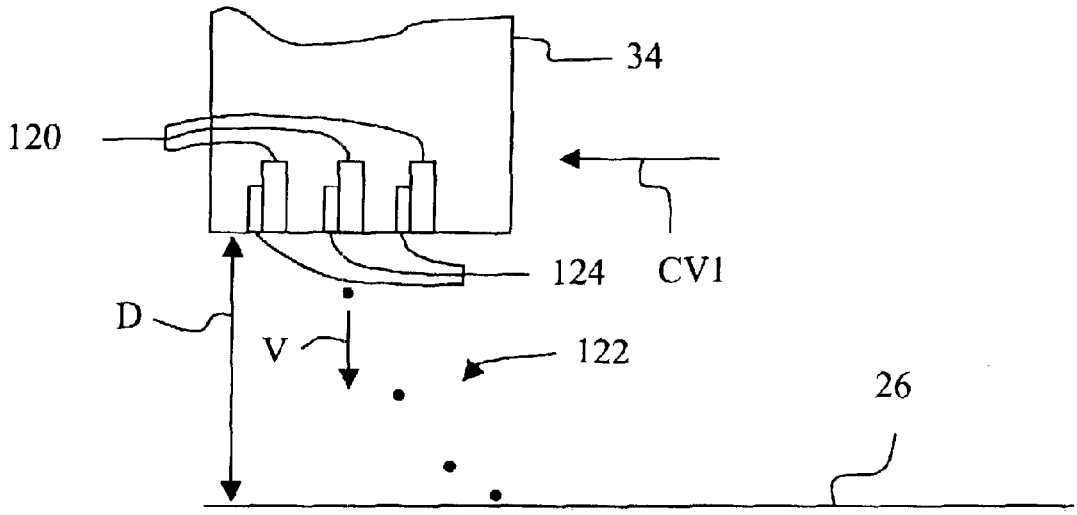
FIG. 4 is a diagrammatic representation of a printhead of the imaging system of FIG. 1.
Figure 5:
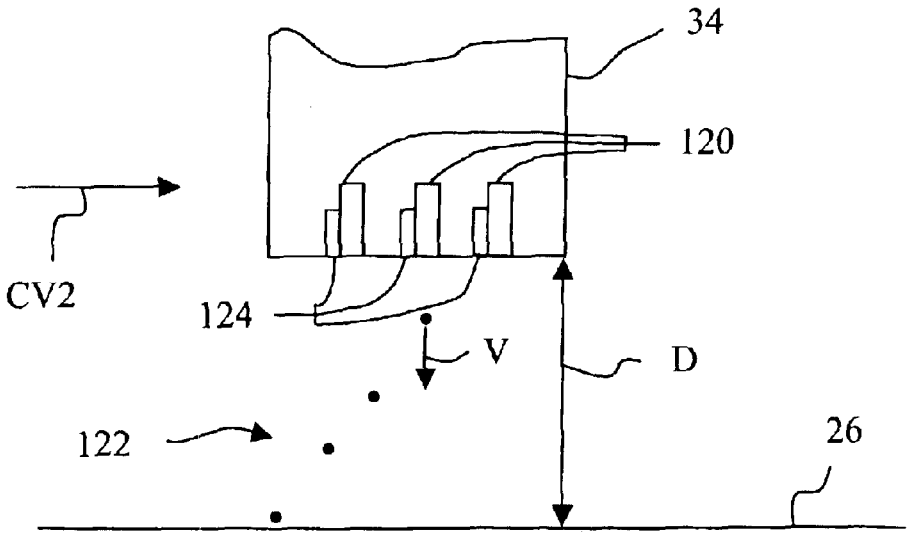
FIG. 5 is another diagrammatic representation of the printhead of FIG. 4.

Now, additionally referring to FIGS. 2–5, there is shown a series of patterns in FIGS. 2 and 3 and a diagrammatic representation of printhead 34 or 36 in FIGS. 4 and 5. Referring to FIG. 2, there is shown a pattern set 100 including pattern 102 and pattern 104. Pattern 102 is a series of lines printed by printhead 34 or 36 at a first carrier velocity CV1. Pattern 104 is printed by the same printhead that printed pattern 102, however, pattern 104 is printed as the printhead is moved at a second carrier velocity CV2. Pattern 104 is somewhat similar to pattern 102 and also consists of a series of vertical lines. Line 106 and line 108 are offset by a distance Y', the significance of which will be further explained in more detail hereafter.

In FIG. 3 there is shown another set of patterns 110 including pattern 112 and pattern 114. Pattern set 110 is similar to pattern set 100 in that pattern 112 is printed at carrier velocity CV1 and pattern 114 is printed at carrier velocity CV2. In FIG. 3 line 116 and line 118 are aligned the significance of which will be further explained in more detail hereafter. Whereas carrier velocities CV1 and CV2 denote the velocities of carrier 32 these are also known as scan velocities CV1 and CV2.

Although pattern sets 100 and 110 are shown as patterns of lines other types of patterns can be utilized. For example, the patterns of a pattern set can overlap each other and/or different geometries can be used in the patterns. Moreover, moiré patterns can be produced.

Now, referring to FIGS. 4 and 5, there is shown an example of printhead 34 including nozzles 120. One or more nozzles 120 eject ink drops 122 toward print medium 26. Ink drops 122 are ejected from nozzles 120 when actuators 124 are energized by an energy level. The energy level can take the form of an energy signal that is supplied for a selected length of time. Actuators 124 may be in the form of a piezo-electric element or in the form of heater elements 124.

While nozzles 120 are ejecting ink drops 122 at velocity V toward print medium 26, printhead 34 is moving at carrier velocity CV1 in a direction shown by the arrow representative of carrier velocity CV1. Printhead 34 is distance D from print medium 26. The velocity V of ink drop 122 is assumed to be a particular value. An energy level is selected that is assumed to correspond with the particular value, such as 500 inches per second, and is used to print patterns such as those shown in FIGS. 2 and 3 to determine if the selected energy level does cause the ink drops to travel at velocity V.

The time that it takes an ink drop 122 to transit distance D is equal to D/V. Ink drop 122 is traveling toward print medium 26 at a vector that results from the combination of the velocity imparted by a nozzle 120 and carrier velocity CV1 or CV2. It is this combination of velocities that determine the place that ink drop 122 lands upon print medium 26. The time that it takes an ink drop 122 to transit distance D, at a presumed ink velocity V, is fixed, based upon distance D remaining substantially unchanged. Knowing the amount of time required to transit distance D, at presumed velocity V, a predetermined offset is calculated so as to fire ink drops 122 at the offset time prior to being located at a certain position along print medium 26. Alternatively, the position of printhead 34 can be used as an offset, knowing the carrier velocity and the assumed ink velocity V.

Pattern 104 or 114 is printed at a different carrier velocity CV2 as shown in FIG. 5. The predetermined offset, which is associated with distance D, also known as printhead gap D, is applied to position dots in alignment with pattern 102 or 112. However, if the actual ink drop velocity varies from the assumed ink drop velocity V, then misalignment of lines, such as that illustrated by lines 106 and 108 will occur. The measured offset Y', of lines 106 and 108, corresponds to a variation in the ink velocity from that which is assumed for that particular energy level. When the assumed ink velocity does match the association with the predetermined offset, then as shown in pattern set 110, lines 116 and 118 associated with the zero component will be substantially aligned.

Figure 6A:
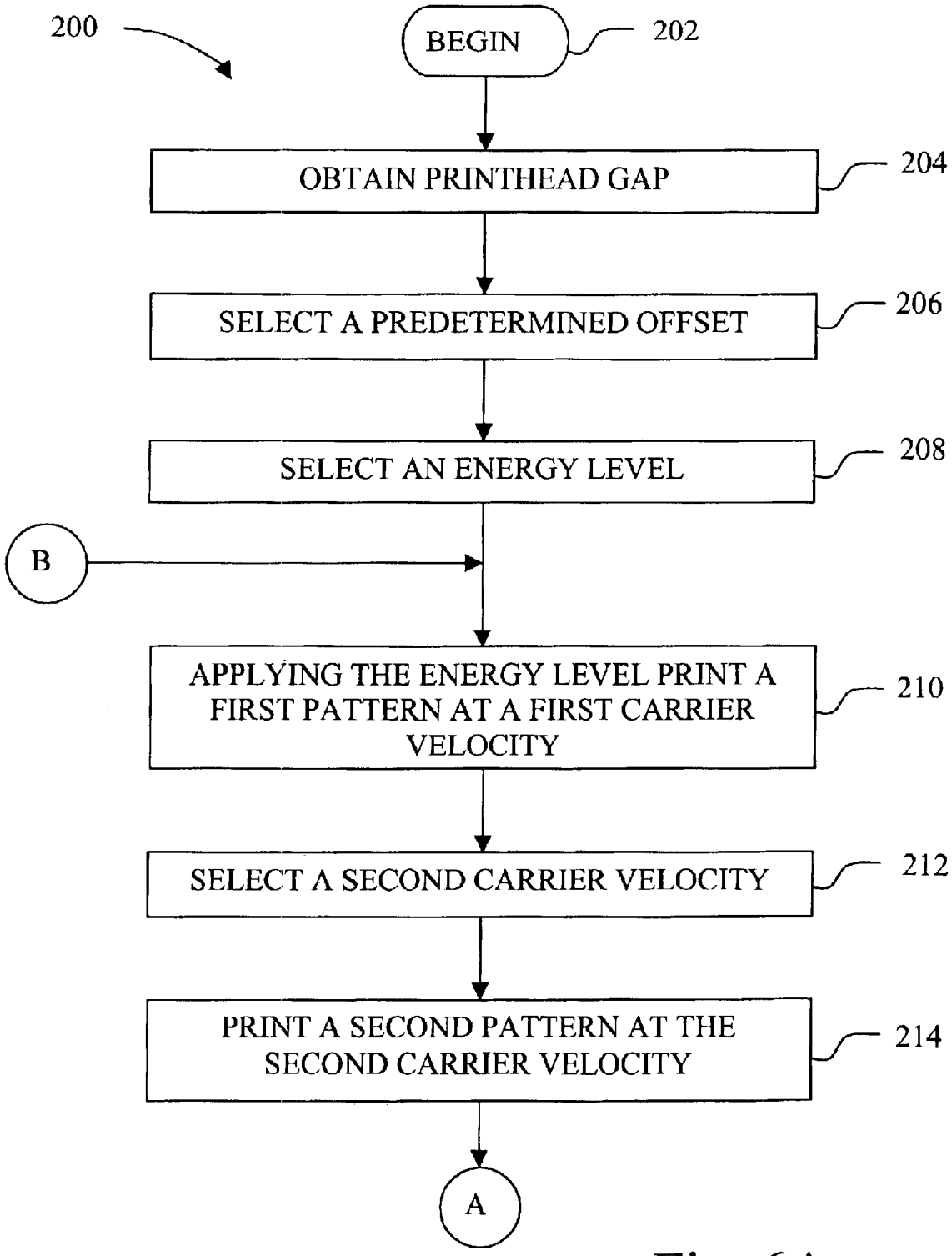
FIGS. 6A and 6B are a block diagram of a method of an embodiment of the present invention utilized in the imaging system of FIG. 1.
Figure 6B:
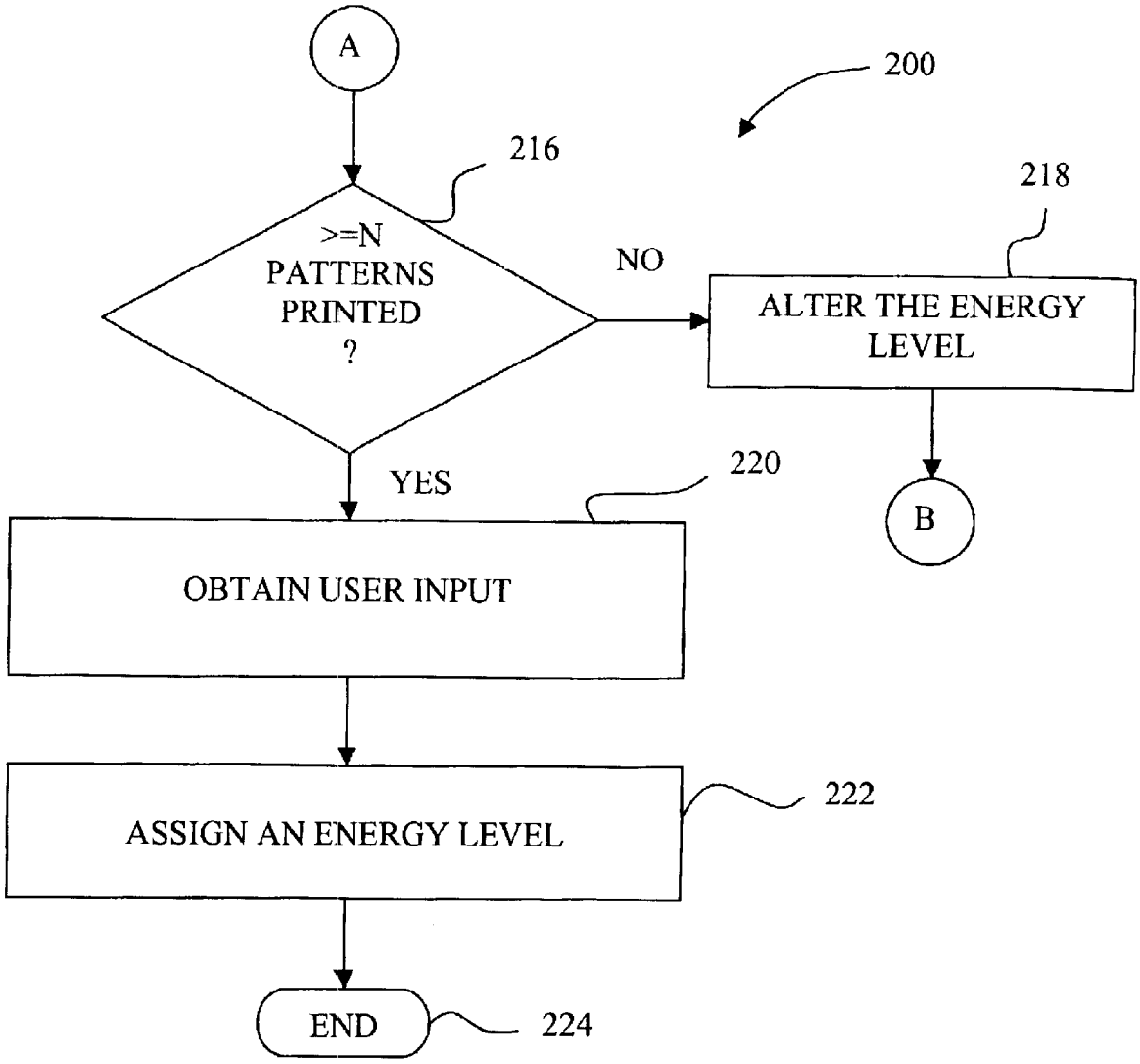

Now, additionally referring to FIGS. 6A and 6B, there is shown a block diagram representing a method according to one embodiment of the present invention used to adjust ink drop velocity, such as through the use of a manual alignment page. The method of FIGS. 6A and 6B are depicted by a plurality of processing steps, hereinafter referred to as process 200, which may be executed by controller 30. Alternatively, process 200 can be executed by computer 12 as it interacts with ink jet printer 14.

Process 200 can be utilized to optimize energy levels used to fire nozzles 120 in a printhead by selecting an energy level that corresponds with a preferred ink drop velocity. Process 200 may be initiated each time one of printheads 34 or 36 is changed. Also, alternatively, process 200 may be periodically initiated to reoptomize the energy levels selected for a particular ink drop velocity of printheads 34 and 36.

Process 200 can be used for either of printheads 34 or 36. For ease of understanding, however, process 200 will be described hereinafter with respect to printhead 34. Process 200 begins at an entry point of 202 and the first step is depicted at step 204, where printhead gap D is obtained. This information may be contained in a memory associated with controller 30 and may be fixed at the factory. Alternatively, printhead gap D may be selected by an operator.

At step 206 a predetermined offset is selected. The predetermined offset is associated with printhead gap D and a target ink drop velocity. The target ink drop velocity can be a preferred velocity for ink drops 122 ejected from printhead 34. The predetermined offset can be in the form of time associated with the movement of printhead 34 such that the time needed for an ink drop to transit the printhead gap at the target ink drop velocity will then cause printhead 34 to eject ink at the predetermined offset time prior to printhead 34 being in the position at which the ink drop 122 is to contact print medium 26. Alternatively, the predetermined offset may be associated with the position of printhead 34 such that when printhead 34 is a predetermined distance, prior to the position that an ink drop is to be placed on print medium 26, then printhead 34 fires the ink drop.

At step 208, controller 30 selects an energy level to be supplied to actuators 124 to eject ink from nozzles 120 of printhead 34. The selection of an energy level can be an assumed default value or the last energy level utilized by a printhead 34.

At step 210, printhead 34 is propelled at a first carrier velocity and prints a first pattern, such as pattern 102 or 112, on print medium 26. The printing of a first pattern is accomplished by supplying the selected energy level to at least one actuator 124 of printhead 34. The predetermined offset is utilized in timing the ejection of ink drops from printhead 34.

At step 212 a second carrier velocity is selected or calculated. Second carrier velocity CV2 can be in an opposite direction to carrier velocity CV1.

At step 214, printhead 34 prints a second pattern, such as pattern 104 or 114. The second pattern is printed at second carrier velocity CV2, again using the predetermined offset. In one embodiment, second patterns 104 or 114 are positioned proximate to first patterns 102 or 112.

At step 216 it is determined if the predetermined number N of patterns have been printed. Each pattern set is associated with a particular energy level. If fewer than N pattern sets have been printed process 200 continues to step 218. However, if N or more pattern sets have been printed, then process 200 continues to step 220.

At step 218, if it has been determined that more pattern sets should be printed, the energy level is altered and process control continues at step 210. At step 220, if it has been determined that a predetermined number of pattern sets has been printed, input from a user of the printer is sought. The input from a user might include entering information relative to each pattern set.

For example, six pattern sets may be printed, each having been printed by printhead 34 utilizing different energy levels, and alignments between elements within each of the six pattern sets are observed by the user. The user associates elements of the two patterns of each pattern set to observe alignments therein. The alignment of elements in each pattern set is information that is thus obtained from the observation.

A type of observation by the user includes comparing patterns within each pattern set, such as which line most closely aligns with a zero line such as lines 116 and 118 of pattern set 110. A pattern set can contain other offset lines which align, such as the plus +2 lines, that are aligned on the rightmost side of FIG. 2. The information thus observed from each pattern set is input either on a control panel on ink jet printer 14 or in a window displayed on computer 12. Alternatively, the pattern set that is most closely aligned to a zero line may be the only information that is input by the user.

At step 222, an energy level is assigned relative to printhead 34, based upon the information input by the user at step 220. The information obtained in step 220 is processed by an algorithm, contained in a memory of either computer 12 or ink jet printer 14, to assign the optimized energy level. The algorithm analyzes the information using a projection technique to select an energy level to achieve the target ink drop velocity. The energy level thus assigned is then subsequently utilized by ink jet printer 14 for energizing printhead 34 as instructed by controller 30, thereby optimizing the energy usage of printhead 34 and achieving the target ink drop velocity. Process control then exits at the exit point 224 of process 200.

Process 200 may then be repeated for printhead 36. When at least one of printheads 34 or 36 are replaced, process 200 can be reinitiated for each of the replaced printheads. Process 200 might also be initiated at timed intervals, after certain numbers of characters are printed or manually by an operator.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an ink jet printer, a method of selecting an optimized energy level associated with a target ink drop velocity, comprising:

moving a printhead across a print medium at a plurality of scan velocities including a first velocity and a second velocity;

printing at least one set of patterns on said print medium by supplying at least one predetermined energy level to at least one actuator of said printhead, said at least one set of patterns including a first pattern printed at said first velocity and a second pattern printed at said second velocity, and selecting the optimized energy level associated with the target ink drop velocity based on an association of the first pattern with the second pattern.

2. The method of claim 1, wherein the association of the patterns is based on an observed alignment of said first pattern with said second pattern.

3. The method of claim 2, wherein the observed alignment is determined by a user of the printer.

4. The method of claim 3, wherein said selecting act further comprises receiving alignment information into the ink jet printer, said alignment information comprising the observed alignment determined by the user.

5. The method of claim 1, further comprising:

varying said second velocity; and repeating said printing act.

6. The method of claim 1, wherein said at least one energy level is a plurality of energy levels, each of said plurality of energy levels being associated with at least one of said set of patterns.

7. The method of claim 6, further comprising associating a predetermined offset with the target ink drop velocity.

8. The method of claim 6, wherein said at least one set of patterns is a plurality of sets of patterns, each of said plurality of sets of patterns associated with a corresponding one of said at least one energy level.

9. The method of claim 8, wherein said selecting act further comprises selecting the optimized energy level associated with a selected one of said plurality of sets of patterns that corresponds substantially with the target ink drop velocity.

10. The method of claim 1, wherein said at least one actuator is at least one heater element.

11. The method of claim 1, wherein said at least one set of patterns is a plurality of sets of patterns.

12. The method of claim 11, further comprising receiving information from each of said plurality of sets of patterns into one of a computer and the ink jet printer.

13. In an ink jet printer, a method of selecting an optimized energy level associated with a target ink drop velocity, comprising:

printing a first pattern on a print medium by supplying an energy level to at least one actuator, said first pattern printed at a first carrier velocity;

printing a second pattern on said print medium by supplying said energy level to said at least one actuator, said second pattern printed at a second carrier velocity, obtaining information as to an alignment of said first pattern and said second pattern; and assigning the optimized energy level based on said information.

14. The method of claim 13, wherein the information obtained in said obtaining act is based on an observed alignment of said first pattern with said second pattern.

15. The method of claim 14, wherein the information is obtained from a user of the printer.

16. The method of claim 15, wherein said selecting act further comprises receiving the information into the ink jet printer.

17. The method of claim 13, further comprising:

associating a predetermined offset with the target ink drop velocity; and using said predetermined offset to effect the timing of printing of said printing a first pattern act and said printing a second pattern act.

18. The method of claim 13, wherein said at least one actuator is at least one heater element.

19. In an ink jet printer, a method of selecting an actuator energy level associated with a target ink drop velocity, comprising:

selecting an energy level to supply to at least one actuator to eject ink from a printhead;

moving said printhead at a first velocity;

placing ink drops from said printhead on a print medium at said first velocity, moving said printhead at a second velocity;

placing additional ink drops on said print medium at said second velocity; and assigning an energy level associated with said ink drops and said additional ink drops as the actuator energy level.

20. The method of claim 19, further comprising receiving information based on a comparison of a pattern of said ink drops on said print medium to a pattern of said additional ink drops on said print medium.

21. The method of claim 20, wherein said assigning act is dependant on said information.

22. The method of claim 19, wherein said first velocity and said second velocity are the same magnitude, but in opposite directions.

23. The method of claim 19, wherein said placing ink drops act and said placing additional ink drops act utilize a predetermined offset associated with the target ink drop velocity to time the activation of said at least one actuator.

24. The method of claim 19, wherein said selecting act further includes altering said energy level.

* * * * *